US008754914B2

(12) United States Patent
Lu

(10) Patent No.: US 8,754,914 B2
(45) Date of Patent: Jun. 17, 2014

(54) TESTING CIRCUIT OF DUAL GATE CELL PANEL AND COLOR DISPLAY METHOD FOR DUAL GATE CELL PANEL

(75) Inventor: Tai-Fu Lu, Tainan (TW)

(73) Assignee: Hannstar Display Corporation, New Taipei (TW)

( * ) Notice: Subject to any disclaimer, the term of this patent is extended or adjusted under 35 U.S.C. 154(b) by 87 days.

(21) Appl. No.: 13/314,546

(22) Filed: Dec. 8, 2011

(65) Prior Publication Data

US 2013/0002738 A1 Jan. 3, 2013

(30) Foreign Application Priority Data

Jun. 30, 2011 (TW) ..... 100123067 A

(51) Int. Cl.
*G09G 5/02* (2006.01)

(52) U.S. Cl.
USPC ..... 345/694

(58) Field of Classification Search
USPC ..... 215/169.3; 345/204, 205, 212, 690, 92; 348/441; 349/144, 48
See application file for complete search history.

(56) References Cited

U.S. PATENT DOCUMENTS

2012/0120034 A1* 5/2012 Lee et al. ..... 345/205

FOREIGN PATENT DOCUMENTS

| | | |
|---|---|---|
| TW | 200819824 | 5/2008 |
| TW | M379085 | 4/2010 |
| TW | M387342 | 8/2010 |
| TW | 201040917 | 11/2010 |
| TW | 201100936 | 1/2011 |

OTHER PUBLICATIONS

"Office Action of Taiwan Counterpart Application", issued on Oct. 23, 2013, p. 1-p. 13.

* cited by examiner

*Primary Examiner* — Sumati Lefkowitz
*Assistant Examiner* — Douglas M Wilson
(74) *Attorney, Agent, or Firm* — Jianq Chyun IP Office

(57) ABSTRACT

A testing circuit of a dual gate cell panel and a color display method of the dual gate cell panel. There are many data lines and scan lines in the dual gate cell panel, and the data lines are divided into three groups, and the scan lines are divided into two groups. The data lines or scan lines of each group are connected respectively to metal wires with a test pad each. When an appropriate signal is inputted to each test pad, the dual gate cell panel shows red, green and blue colors individually, so that defects of the dual gate cell panel can be detected accurately to avoid any unnecessary waste on the defective dual gate cell panel incurred in the subsequent manufacturing processes.

7 Claims, 5 Drawing Sheets

TESTING CIRCUIT OF DUAL GATE CELL PANEL AND COLOR DISPLAY METHOD FOR DUAL GATE CELL PANEL

CROSS-REFERENCE TO RELATED APPLICATION

This application claims the benefit of Taiwan Patent Application No. 100123067, filed on Jun. 30, 2011, in the Taiwan Intellectual Property Office, the disclosure of which is incorporated herein in its entirety by reference.

FIELD OF THE INVENTION

The present invention relates to a testing circuit and a display method of a liquid crystal display panel, in particular to the testing circuit of a dual gate cell panel and a color display method of the dual gate cell panel.

BACKGROUND OF THE INVENTION

With reference to FIG. 1 for a schematic view of a conventional shorting bar testing architecture of a dual gate cell panel, the dual gate cell panel 1 comprises a plurality of pixels P, a transistor switch Tn, an electrode E, a scan line gn, a data line Dn, a plurality of metal wires 101, 102 and a plurality of test pads 121, 122, wherein the pixels P are distributed in a pixel array on the dual gate cell panel 1, and each pixel P includes three sub-pixels including a red sub-pixel R, a green sub-pixel G and a blue sub-pixel B. Gate, source and drain electrodes of the transistor switch Tn of a sub-pixel are coupled to the scan line gn, the data line Dn and the electrode E of the sub-pixel respectively, and the brightness of the color of each sub-pixel is controlled by one scan line gn and one data line Dn.

In the conventional shorting bar testing architecture of the dual gate cell panel 1, all scan lines gn are electrically coupled through the metal wire 101, and all data lines Dn are electrically coupled through the metal wire 102. The testing signal includes a scan signal source 111 and an image signal source 112, and the scan signal source 111 and the image signal source 112 are coupled to the test pad 121 of the metal wire 101 and the test pad 122 of the metal wire 102 respectively and outputted to the plurality of scan lines gn and the plurality of data lines Dn of the dual gate cell panel 1 in order to perform a display test of the dual gate cell panel 1.

When the scan signal source 111 drives and turns on the transistor switch Tn, the image signal source 112 will affect the operation of related devices, such that the dual gate cell panel 1 can display a color or a pattern as required. The color display principle of the dual gate cell panel 1 is a prior art, and thus will not be described here. Simply speaking, when the transistor switch Tn of the sub-pixel is turned on, the closer the voltage of an image signal 112 to the reference voltage (V-common), the brighter is the color of the sub-pixel. If the difference between the voltage of the image signal 112 and the reference voltage reaches a predetermined value, then the color of the sub-pixel will not be displayed. Wherein, if the reference voltage is equal to 5 volts, and if the voltage of the image signal 112 is equal to 4.9 volts or 5.1 volts, then a very bright color of the sub-pixel will be displayed. If the voltage of the image signal 112 is equal to 10 volts or 0 volt, then the color of the sub-pixel will not be displayed.

Since the dual gate cell panel 1 adopts the shorting bar testing architecture for performing the display test, all data lines Dn and all scan lines gn are electrically coupled together, and then the image signal source 112 and the scan signal source 111 are outputted respectively, so that the red, green and blue colors cannot be displayed individually. During the test, the red, green and blue colors cannot be displayed individually, so that some defects cannot be detected, and the undetected defective dual gate cell panel 1 will still go through the subsequent manufacturing process until a higher-precision product test is preformed, such defective dual gate cell panel 1 will be detected at that time, and then discarded or recycled. In other words, unnecessary manufacturing costs incurred after the display test of the defective dual gate cell panel 1 takes place is wasted.

SUMMARY OF THE INVENTION

In view of the drawbacks of the prior art, it is a primary objective of the present invention to provide a testing circuit of a dual gate cell panel and a color display method for the dual gate cell panel. The testing circuit of a dual gate cell panel allows the dual gate cell panel to display red, green and blue colors individually during the display test. Through a monochrome display of the dual gate cell panel, more defective dual gate cell panel can be detected than the conventional shorting bar test, and then discarded or recycled immediately, so as to avoid any unnecessary waste on the manufacturing cost of the defective dual gate cell panel in the subsequent manufacturing process.

To achieve the aforementioned objective, the present invention provides a testing circuit of a dual gate cell panel, wherein all data lines of the dual gate cell panel are divided into three groups, respectively: a first group of data lines, a second group of data lines and a third group of data lines, and transversally arranged in cycle and in a sequential order of the first-group data lines, the second-group data lines and the third-group data lines. Further, all of the first-group data lines, second-group data lines and third-group data lines are electrically coupled to a first test pad, a second test pad and a third test pad, wherein the first-group data lines are coupled to a plurality of first sub-pixels and a plurality of second sub-pixels, and the second-group data lines are coupled to a plurality of third sub-pixels and a plurality of fourth sub-pixels, and the third-group data lines are coupled to a plurality of fifth sub-pixels and a plurality of sixth sub-pixels.

Wherein, each of the sub-pixels includes a transistor switch electrically coupled to a scan line and a data line, such that when an ON signal is passed into a first group of scan lines, the corresponding transistor switches of the first group of scan lines are turned ON, and an OFF signal is passed through a second group of scan lines. If a display signal is passed into the first-group data lines, then the first sub-pixels will display the first color.

The present invention further provides a color display method for a dual gate cell panel, and the method is applied to a display test of the dual gate cell panel, and the color display method comprises the steps of: providing a first periodic signal to a plurality of first scan lines to turn on or off a plurality of transistor switches coupled to the first group of scan lines respectively; providing a second periodic signal corresponding to the first periodic signal to a plurality of second scan lines to turn on or off a plurality of transistor switches coupled to the second scan lines respectively; and providing a third periodic signal to a plurality of first-group data lines, such that when the transistor switch coupled to each of the first scan lines or each of the second scan lines is turned on, the third periodic signal drives the plurality of first sub-pixels of each of the first-group data lines to display a first color or a plurality of second sub-pixels to display a second color. The pixels are arranged in a pixel array and each pixel includes sub-pixels, and gate electrodes of the translator switches of the sub-pixels at odd rows of each column are coupled to the same scan line, and these scan lines are called a first group of scan lines; and gate electrodes of the transistor switches of sub-pixels at even rows of each column is coupled to the same group of scan lines, and these scan lines are called a second group of scan lines. All of the first-group scan lines and the second-group scan lines are electrically coupled to the fourth test pad and the fifth test pad respectively.

In a display test of the dual gate cell panel, if appropriate signals are inputted to the first test pad, the second test pad, the third test pad, the fourth test pad and the fifth test pad respectively, the dual gate cell panel will be able to display red, green and blue colors individually. During the display test, any defect dual gate cell panel can be detected easily, so that the defective dual gate cell panel can be discarded or recycled timely to save any unnecessary manufacturing cost incurred in the subsequent manufacturing process of the defective dual gate cell panel.

DESCRIPTION OF THE PREFERRED EMBODIMENTS

The technical characteristics and effects of the present invention will become apparent by the detailed description of preferred embodiments and related drawings as follows. For simplicity, same numerals are used to represent respective elements in the preferred embodiment and drawings.

Figure 1:
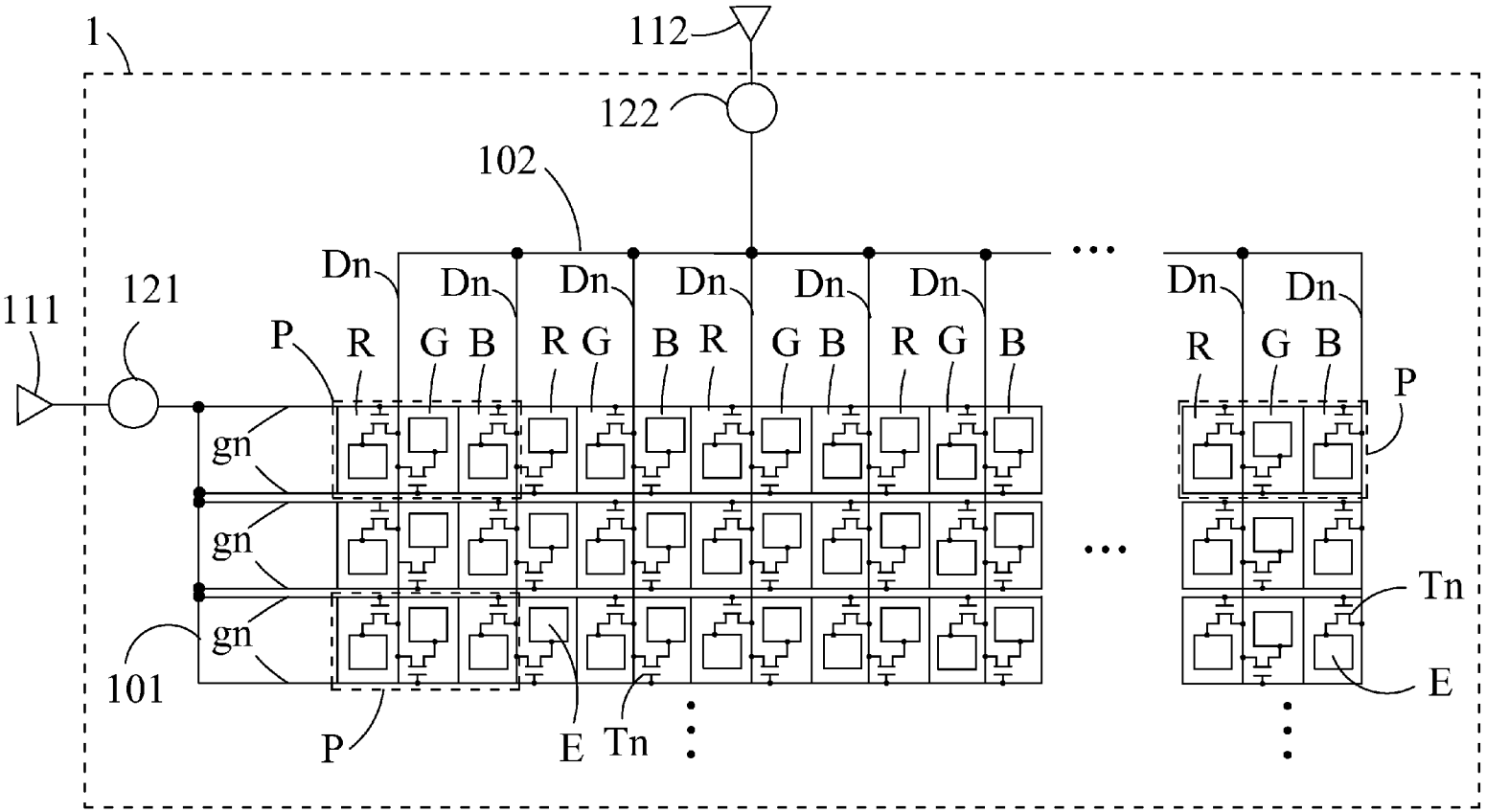
(PRIOR ART) FIG. 1
FIG. 1 is a schematic view of a shorting bar testing architecture of a conventional dual gate cell panel.
Figure 2:
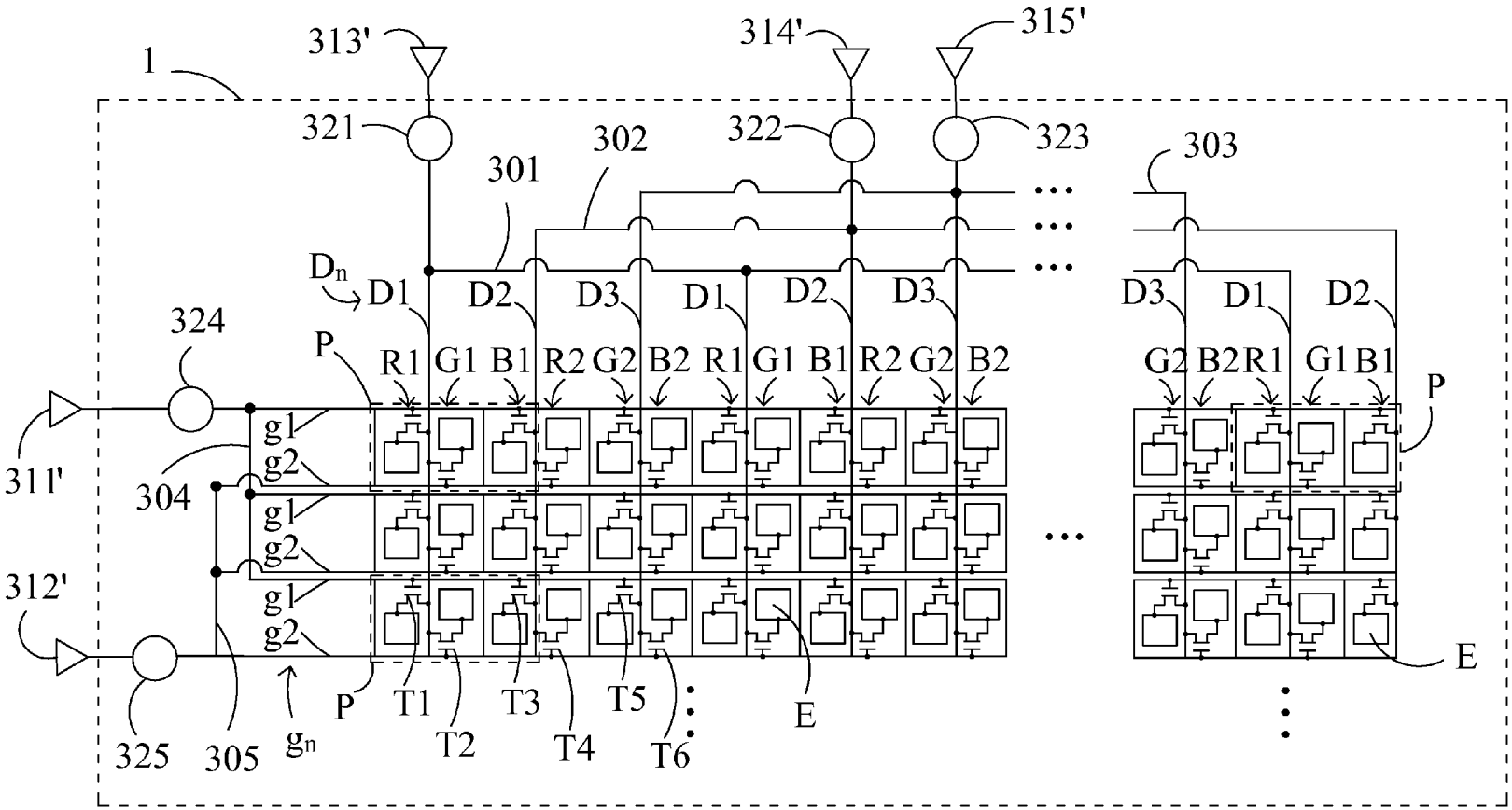
FIG. 2 is a schematic view of a testing circuit of a dual gate cell panel in accordance with the present invention.

With reference to FIG. 2 for a schematic view of a testing circuit of a dual gate cell panel in accordance with a preferred embodiment of the present invention, the dual gate cell panel 1 is substantially the same as the dual gate cell panel 1 shown in FIG. 1, except that the plurality of data lines Dn and the plurality of scan lines gn are grouped in this preferred embodiment, and the same group of data lines Dn or scan lines gn are coupled to a same metal wire, and the metal wire is coupled to a test pad. More specifically, the data lines Dn as shown in FIG. 2 are divided into a first group of data lines D1, a second group of data lines D2 and a third group of data lines D3, and arranged transversally in a cycle and in a sequential order of the first group of data lines D1, the second group of data lines D2 and the third group of data lines D3, and all of the first-group data lines D1, the second-group data lines D2 and the third-group data lines D3 are electrically coupled to a first metal wire 301, a second metal wire 302 and a third metal wire 303 respectively, and the first metal wire 301, second metal wire 302 and third metal wire 303 are electrically coupled to a first test pad 321, a second test pad 322 and a third test pad 323 respectively.

The pixels P are arranged into an array of pixels P, and each pixel P includes sub-pixels, and gate electrodes of the transistor switches T1, T3 and T5 of the sub-pixels at odd rows of each column are coupled to the first-group scan lines g1 respectively, and gate electrodes of the transistor switches T2, T4 and T6 of sub-pixels at even rows of each column are coupled to the second-group scan lines g2 respectively. In addition, all of the first-group scan lines g1 and the second-group scan lines g2 are electrically coupled to a fourth metal wire 304 and a fifth metal wire 305 respectively, and the fourth metal wire 304 and fifth metal wire 305 are coupled to a fourth test pad 324 and a fifth test pad 325 respectively.

For simplicity, the sub-pixels are classified and measured in the unit of "row". Wherein, the first group of data lines D1 controls the display of a red sub-pixel R1 and a green sub-pixel G1, and the second group of data lines D2 controls the display of a blue sub-pixel B1 and a red sub-pixel R2, and the third group of data lines D3 controls the display of a green sub-pixel G2 and a blue sub-pixel B2. In addition, the first group of scan lines g1 also controls the display of the red sub-pixel R1, the blue sub-pixel B1 and the green sub-pixel G2, and the second group of scan lines g2 also controls the display of the green sub-pixel G1, the red sub-pixel R2 and the blue sub-pixel B2. During a display, both red sub-pixel R1 and red sub-pixel R2 display a red color, both green sub-pixel G1 and green sub-pixel G2 display a green color, and both blue sub-pixel B1 and blue sub-pixel B2 display a blue color.

In a display test of the dual gate cell panel 1, a first periodic signal 311 of a first periodic signal source 311', a second periodic signal 312 of a second periodic signal source 312', a third periodic signal 313 of a third periodic signal source 313' a fourth periodic signal 314 of a fourth periodic signal source 314' and a fifth periodic signal 315 of a fifth periodic signal source 315' are passed into the fourth test pad 324, the fifth test pad 325, the first test pad 321, the second test pad 322 and the third test pad 323 respectively, so that the dual gate cell panel 1 can display the red color of the red sub-pixels R1 and R2, the green color of the green sub-pixels G1 and G2 or the blue color of the blue sub-pixels B1 and B2 individually. Therefore, the defective dual gate cell panel 1 can be detected easily in the display test, and the defective dual gate cell panel 1 can be discarded or recycled timely to save any unnecessary manufacturing cost incurred in the subsequent manufacturing process of the defective dual gate cell panel 1.

Figure 3:
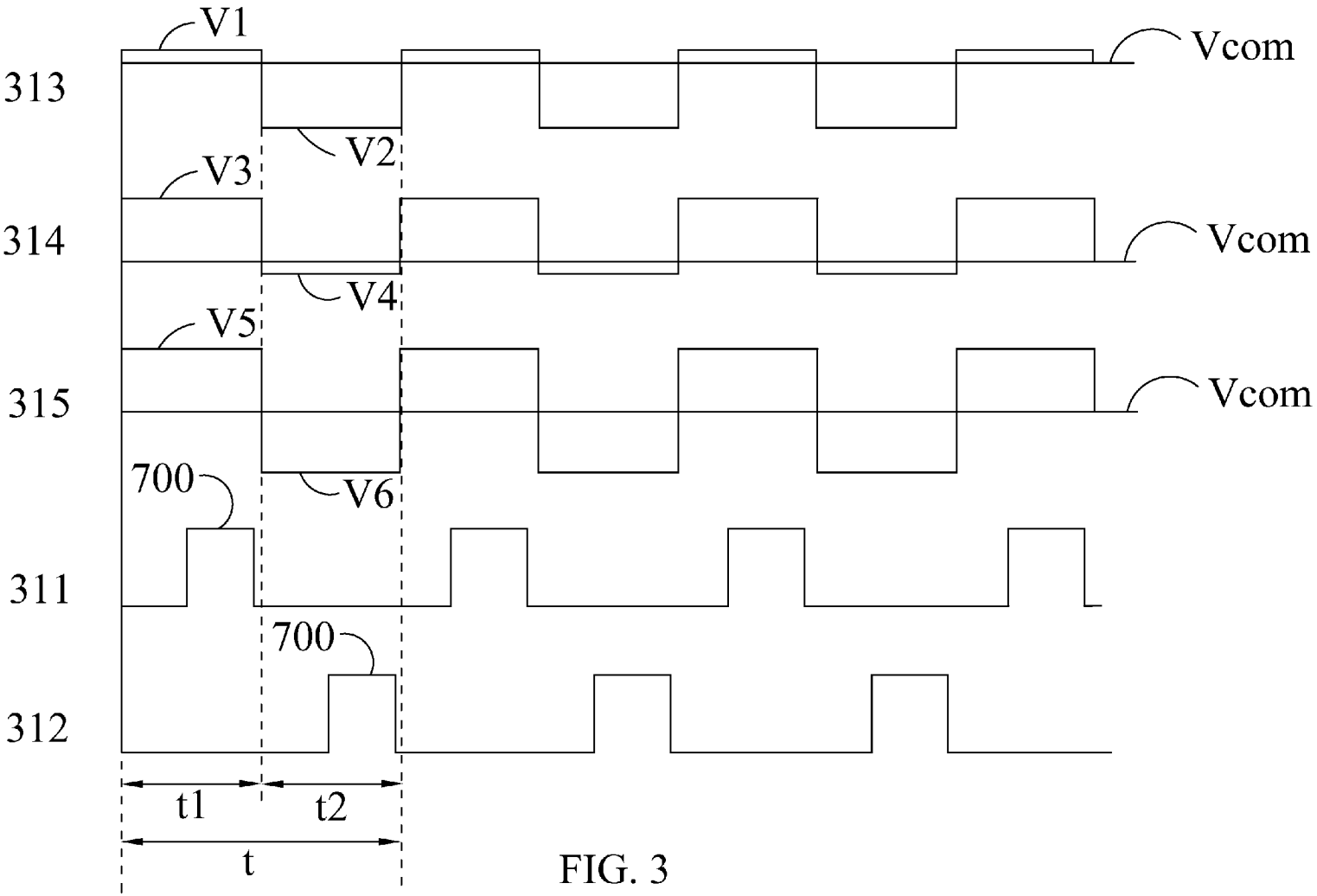
FIG. 3 is a waveform chart of a signal for displaying a red color individually in accordance the preferred embodiment of the present invention as shown in FIG. 2.
Figure 4:
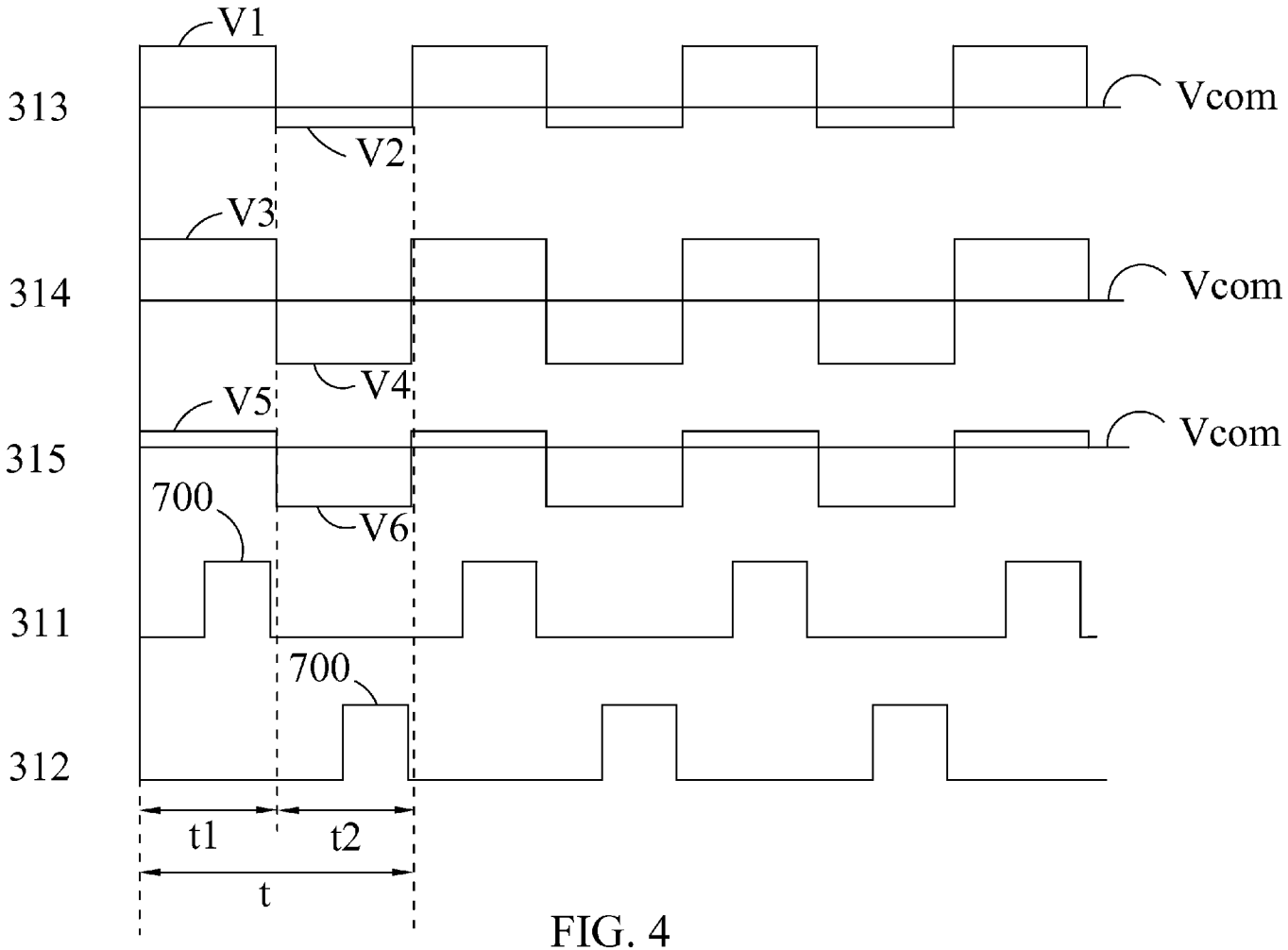
FIG. 4 is a waveform chart of a signal for displaying a green color individually in accordance with the preferred embodiment of the present invention as shown in FIG. 2.
Figure 5:
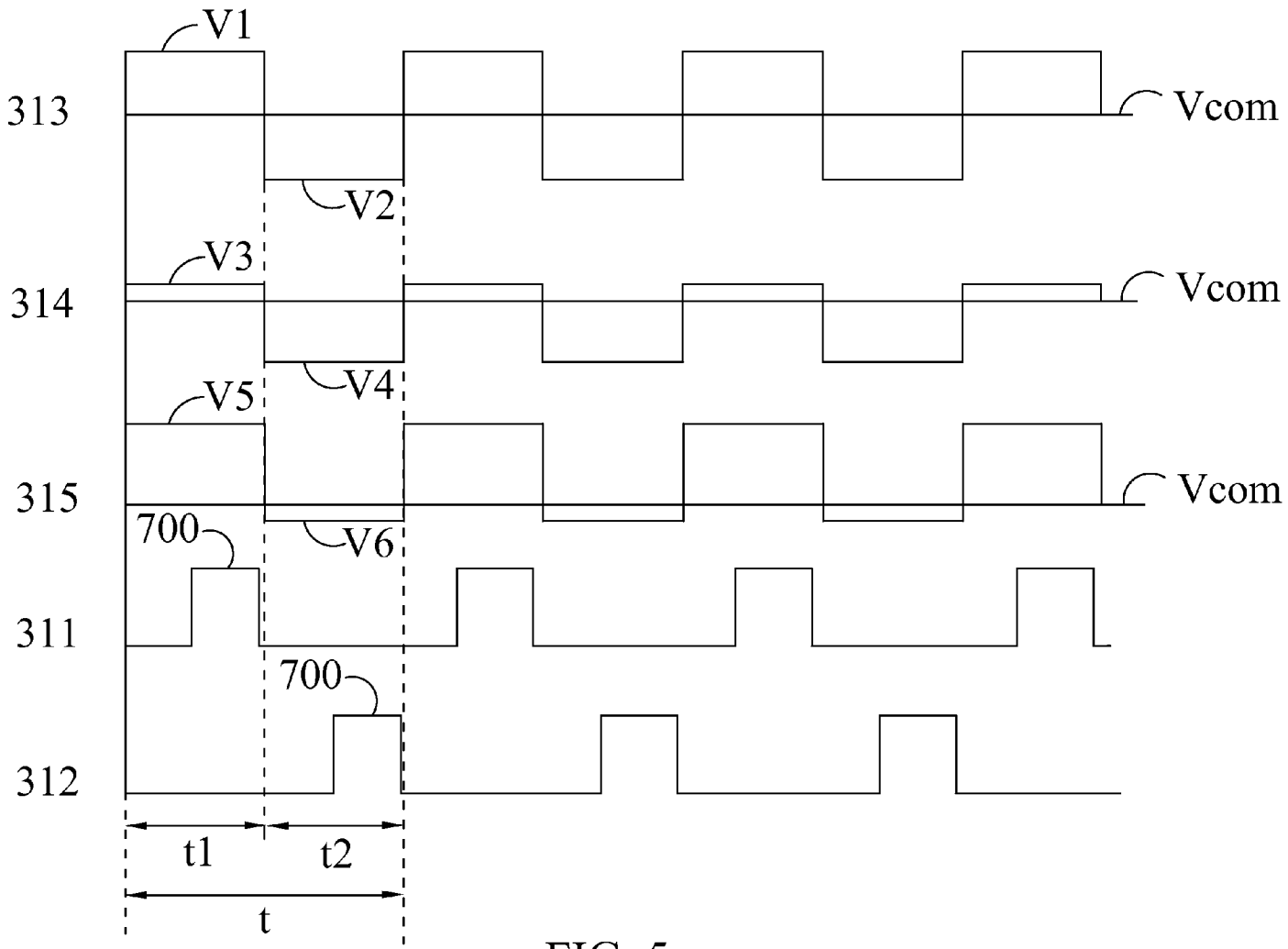
FIG. 5 is a waveform chart of a signal for displaying a blue color individually in accordance with the preferred embodiment of the present invention as shown in FIG. 2.

Since the dual gate cell panel 1 as shown in FIG. 2 provides an appropriate signal to the dual gate cell panel 1 in the display test, therefore the dual gate cell panel 1 can display colors to achieve the testing purpose, and the present invention further provides a color display method for the dual gate cell panel. With reference to FIGS. 3, 4 and 5 as well as FIG. 2, FIG. 3 shows a signal waveform chart of a preferred embodiment as depicted in FIG. 2 for displaying red sub-pixels individually, FIG. 4 shows a signal waveform chart of a preferred embodiment as depicted in FIG. 2 for displaying green sub-pixels individually, and FIG. 5 shows a signal waveform chart of a preferred embodiment as depicted in FIG. 2 for displaying blue sub-pixels individually. Wherein, the horizontal axis represents a change of time, and the vertical axis represents a change of voltage.

In the color display method for a dual gate cell panel, the first periodic signal 311, second periodic signal 312, third periodic signal 313, fourth periodic signal 314 and fifth periodic signal 315 are inputted into the fourth test pad 324, fifth test pad 325, first test pad 321, second test pad 322 and third test pad 323 as depicted in FIG. 2 respectively. Wherein, the first periodic signal 311~the fifth periodic signal 315 are periodic signals having the same cycle t. Wherein, the voltages of the third periodic signal 313, fourth periodic signal 314 and fifth periodic signal 315 at a first-half cycle t1 are a first voltage V1, a third voltage V3 and a fifth voltage V5 respectively, and their voltages at a second-half cycle t2 are a second voltage V2, a fourth voltage V4 and a sixth voltage V6 respectively. In addition, the first periodic signal 311 and the second periodic signal 312 are periodic signal with a periodic pulse wave 700, and the voltage of the pulse wave 700 drives and turns on the transistor switches T1~T6 coupled to the first group of scan lines g1 and the second group of scan lines g2. Wherein, the pulse wave 700 of the first periodic signal 311 only shows up in the middle to rear sections of the first-half cycle t1, and the pulse wave 700 of the second periodic signal 312 only shows up in the middle to rear sections of the second-half cycle t2. When no pulse wave 700 of the first periodic signal 311 and the second periodic signal 312 shows up, it means that the transistor switches T1~T6 are OFF. In other words, if an ON signal is passed into the scan lines, the corresponding transistor switches of the first group of scan lines are turned on, and an OFF signal is passed into the second group of scan lines.

Since the display mechanism of the dual gate cell panel 1 is not a key point of the present invention, therefore the display mechanism of the dual gate cell panel 1 is described briefly here. If the transistor switches T1~T6 of the sub-pixels are OFF, the sub-pixels will not display colors. If the transistor switches T1~T6 of the sub-pixels are ON, and the voltage of source electrodes of the transistor switches T1~T6 is closer to a reference voltage Vcom, then the color of the sub-pixels will be brighter. Wherein, the voltage of the source electrodes of the transistor switches T1~T6 comes from the third periodic signal 313, fourth periodic signal 314 or fifth periodic signal 315. For example, if the reference voltage Vcom is equal to 5 volts, and the voltage of the source electrode is equal to 5.1 volts or 4.9 volts, the color of the sub-pixels is the brightest. If the voltage of the source electrode is much greater than 5.1 volts or smaller than 4.9 volts, the color of the displayed sub-pixels will be darker. If the voltage of the source electrodes is equal to 10 volts or 0 volt, no color of the sub-pixels can be observed. In other words, if a display signal is passed into the first group of data lines, then the first sub-pixel will display the first color.

The procedure of displaying the red sub-pixels R1 and R2, green sub-pixels G1 and G2 or blue sub-pixels B1 and B2 individually in accordance with a preferred embodiment as depicted in FIG. 2 is described as follows:

(1) With reference to FIGS. 2 and 3 for the dual gate cell panel 1 capable of displaying the red sub-pixels R1 and R2 individually, the following steps (a) and (b) are provided for describing the situations of the first periodic signal 311~the fifth periodic signal 315 at the first-half cycle t1 and the second-half cycle t2.

(a) In the first-half cycle t1, the third voltage V3 of the fourth periodic signal 314 and the fifth voltage V5 of the fifth periodic signal 315 are equal to 10 volts, and no pulse wave 700 shows up in the second periodic signal 312. Now, the first voltage V1 of the third periodic signal 313 is equal to 5.1 volts, and the pulse wave 700 of the first periodic signal 311 shows up at middle to rear periods of the first-half cycle t1. At the beginning of the first-half cycle t1, all sub-pixels are dark. Until the pulse wave 700 of the first periodic signal 311 shows up, the transistor switches T1, T3 and T5 coupled to the first group of scan lines g1 are turned on, and only the red color of the red sub-pixel R1 controlled by the first group of data lines D1 is displayed.

(b) In the second-half cycle t2, the second voltage V2 of the third periodic signal 313 and the sixth voltage V6 of the fifth periodic signal 315 are equal to 0 volt, and no pulse wave 700 of the first periodic signal 311 shows up. Now, the fourth voltage V4 of the fourth periodic signal 314 is equal to 4.9 volts, and the pulse wave of the second periodic signal 312 shows up at a middle to rear period of the second-half cycle t2. At the beginning of the second-half cycle t2, all sub-pixels are dark. Until the pulse wave 700 of the second periodic signal 312 shows up, the transistor switches T2, T4 and T6 coupled to the second group of scan lines g2 are turned on. Now, only the red color of the red sub-pixel R2 controlled by the second group of data lines D2 is displayed.

In the steps 1(*a*) and 1(*b*), the dual gate cell panel 1 displays the red color of the red sub-pixels R1 and R2 individually in the display test.

(2) With reference to FIGS. 2 and 4 for the dual gate cell panel 1 capable of displaying the green color of the green sub-pixels G1 and G2 individually, the following steps (a) and (b) are provided for describing the situations of the first periodic signal 311~the fifth periodic signal 315 at the first-half cycle t1 and the second-half cycle t2.

(a) In the first-half cycle t 1, the first voltage V1 of the third periodic signal 313 and the third voltage V3 of the fourth periodic signal 314 are equal to 10 volts, and no pulse wave 700 shows up in the second periodic signal 312. Now, the fifth voltage V5 of the fifth periodic signal 315 is equal to 5.1 volts, and the pulse wave 700 of the first periodic signal 311 shows up at middle to rear periods of the first-half cycle t1. At the beginning of the first-half cycle t1, all sub-pixels are dark. Until the pulse wave 700 of the first periodic signal 311 shows up, the transistor switches T1, T3 and T5 coupled to the first group of scan lines g1 are turned on, and only the green color of the green sub-pixel G2 controlled by the third group of data lines D3 is displayed.

(b) In the second-half cycle t2, the fourth voltage V4 of the fourth periodic signal 314 and the sixth voltage V6 of the fifth periodic signal 315 are equal to 0 volt, and no pulse wave 700 of the first periodic signal 311 shows up. Now, the second voltage V2 of the third periodic signal 313 is equal to 4.9 volts, and the pulse wave of the second periodic signal 312 shows up at a middle to rear period of the second-half cycle t2. At the beginning of the second-half cycle t2, all sub-pixels are dark. Until the pulse wave 700 of the second periodic signal 312 shows up, the transistor switches T2, T4 and T6 coupled to the second group of scan lines g2 are turned on. Now, only the green color of the green sub-pixel G1 controlled by the first group of data lines D1 is displayed.

By the steps of 2(*a*) and 2(*b*), the dual gate cell panel 1 can display the green color of the green sub-pixels G1 and G2 in the display test.

(3) With reference to FIGS. 2 and 5 for the dual gate cell panel 1 capable of displaying the blue color of the blue sub-pixels B1 and B2 individually, the following steps (a) and (b) are provided for describing the situations of the first periodic signal 311~the fifth periodic signal 315 at the first-half cycle t1 and the second-half cycle t2.

(a) In the first-half cycle t1, the first voltage V1 of the third periodic signal 313 and the fifth voltage V5 of the fifth periodic signal 315 are equal to 10 volts, and no pulse wave 700 shows up in the second periodic signal 312. Now, the third voltage V3 of the fourth periodic signal 314 is equal to 5.1 volts, and the pulse wave 700 of the first periodic signal 311 shows up at middle to rear periods of the first-half cycle t1. At the beginning of the first-half cycle t1, all sub-pixels are dark. Until the pulse wave 700 of the first periodic signal 311 shows up, the transistor switches T1, T3 and T5 coupled to the first group of scan lines g1 are turned on, and only the blue color of the blue sub-pixel B1 controlled by the second group of data lines D2 is displayed.

(b) In the second-half cycle t2, the second voltage V2 of the third periodic signal 313 and the fourth voltage V4 of the fourth periodic signal 314 are equal to 0 volt, and no pulse wave 700 of the first periodic signal 311 shows up. Now, the sixth voltage V6 of the fifth periodic signal 315 is equal to 4.9 volts, and the pulse wave of the second periodic signal 312 shows up at a middle to rear period of the second-half cycle t2. At the beginning of the second-half cycle t2, all sub-pixels are dark. Until the pulse wave 700 of the second periodic signal 312 shows up, the transistor switches T2, T4 and T6 coupled to the second group of scan lines g2 are turned on. Now, only the blue color of the blue sub-pixel B2 controlled by the third group of data lines D3 is displayed.

By the steps of 3(*a*) and 3(*b*), the dual gate cell panel 1 can display the blue color of the blue sub-pixels B1 and B2 in the display test.

In summation of the description above, the testing circuit of a dual gate cell panel and the color display method for the dual gate cell panel in accordance with the present invention can display red, green and blue colors individually from the dual gate cell panel in the display test. With a monochrome display of the dual gate cell panel, a defective dual gate cell panel can be detected accurately and timely, so that the defective dual gate cell panel can be discarded or recycle immediately to avoid any unnecessary waste on the defective dual gate cell panel incurred in the subsequent manufacturing processes.

What is claimed is:

1. A testing circuit of a dual gate cell panel, the testing circuit being installed on the dual gate cell panel, and the testing circuit comprising:

a first group of data lines, electrically coupled to a first test pad, and coupled to a plurality of first sub-pixels and a plurality of second sub-pixels;

a second group of data lines, electrically coupled to a second test pad, and coupled to a plurality of third sub-pixels and a plurality of fourth sub-pixels;

a third group of data lines, electrically coupled to a third test pad, and coupled to a plurality of fifth sub-pixels and a plurality of sixth sub-pixels;

a first group of scan lines, electrically coupled to a fourth test pad, and coupled to the first sub-pixels, the third sub-pixels and the fifth sub-pixels; and a second group of scan lines, electrically coupled to a fifth test pad, and coupled to the second sub-pixels, the fourth sub-pixels and the sixth sub-pixels;

wherein, the first sub-pixels and the fourth sub-pixels are first color sub-pixels, and the second sub-pixels and the fifth sub-pixels are second color sub-pixels, and the third sub-pixels and the sixth sub-pixels are third color sub-pixels, wherein, each of the first sub-pixels, each of the second sub-pixels, each of the third sub-pixels, each of the fourth sub-pixels, each of the fifth sub-pixels and each of the sixth sub-pixels are individually displayed in response to a first to a fifth periodic signals respectively inputted into the fourth, the fifth, the first, the second and the third test pads, wherein the phase of one of the first and second periodic signals is opposite to the phase of another one of the first and second periodic signals and the phases of the third, fourth, and fifth periodic signals.

2. The testing circuit as claimed in claim 1, wherein the cycle of each of first to the fifth periodic signals has a first-half cycle and a second-half cycle, wherein during the first-half cycle, when the first periodic signal inputted into the fourth test pad is enabled, the second periodic signal inputted into the fifth test pad is disabled, a level of the third periodic signal inputted into the first test pad is much close to a reference voltage, a voltage difference between a level of the fourth periodic signal inputted into the second test pad and the reference voltage is greater than a predetermined value and a voltage difference between a level of the fifth periodic signal inputted into the third test pad and the reference voltage is greater than the predetermined value, only the first sub-pixels are displayed, wherein during the second-half cycle, when the first periodic signal inputted into the fourth test pad is disabled, the second periodic signal inputted into the fifth test pad is enabled, a voltage difference between the level of the third periodic signal inputted into the first test pad and the reference voltage is greater than the predetermined value, the level of the fourth periodic signal inputted into the second test pad is much close to the reference voltage and the voltage difference between the level of the fifth periodic signal inputted into the third test pad and the reference voltage is greater than the predetermined value, only the fourth sub-pixels are displayed.

3. The testing circuit as claimed in claim 1, wherein the cycle of each of first to the fifth periodic signals has a first-half cycle and a second-half cycle, wherein during the first-half cycle, when the first periodic signal inputted into the fourth test pad is enabled, the second periodic signal inputted into the fifth test pad is disabled, a voltage difference between a level of the third periodic signal inputted into the first test pad and a reference voltage is greater than a predetermined value, a voltage difference between a level of the fourth periodic signal inputted into the second test pad and the reference voltage is greater than the predetermined value and a level of the fifth periodic signal inputted into the third test pad is much close to the reference voltage, only the fifth sub-pixels are displayed, wherein during the second-half cycle, when the first periodic signal inputted into the fourth test pad is disabled, the second periodic signal inputted into the fifth test pad is enabled, the level of the third periodic signal inputted into the first test pad is much close to the reference voltage, the voltage difference between the level of the fourth periodic signal inputted into the second test pad and the reference voltage is greater than the predetermined value, and a voltage difference between the level of the fifth periodic signal inputted into the third test pad and the reference voltage is greater than the predetermined value, only the second sub-pixels are displayed.

4. The testing circuit as claimed in claim 1, wherein the cycle of each of first to the fifth periodic signals has a first-half cycle and a second-half cycle, wherein during the first-half cycle, when the first periodic signal inputted into the fourth test pad is enabled, the second periodic signal inputted into the fifth test pad is disabled, a voltage difference between a level of the third periodic signal inputted into the first test pad and a reference voltage is greater than a predetermined value, a level of the fourth periodic signal inputted into the second test pad is much close to the reference voltage and a voltage difference between a level of the fifth periodic signal inputted into the third test pad and the reference voltage is greater than the predetermined value, only the third sub-pixels are displayed, wherein during the second-half cycle, when the first periodic signal inputted into the fourth test pad is disabled, the second periodic signal inputted into the fifth test pad is enabled, the voltage difference between the level of the third periodic signal inputted into the first test pad and the reference voltage is greater than the predetermined value, a voltage difference between the level of the fourth periodic signal inputted into the second test pad and the reference voltage is greater than the predetermined value and the level of the fifth periodic signal inputted into the third test pad is much close to the reference voltage, only the sixth sub-pixels are displayed.

5. The testing circuit as claimed in claim 2, wherein during the first-half cycle, when the first periodic signal inputted into the fourth test pad is disabled, all the first to the sixth sub-pixels are dark, wherein during the second-half cycle, when the second periodic signal inputted into the fifth test pad is disabled, all the first to the sixth sub-pixels are dark.

6. The testing circuit as claimed in claim 3, wherein during the first-half cycle, when the first periodic signal inputted into the fourth test pad is disabled, all the first to the sixth sub-pixels are dark, wherein during the second-half cycle, when the second periodic signal inputted into the fifth test pad is disabled, all the first to the sixth sub-pixels are dark.

7. The testing circuit as claimed in claim 4, wherein during the first-half cycle, when the first periodic signal inputted into the fourth test pad is disabled, all the first to the sixth sub-pixels are dark, wherein during the second-half cycle, when the second periodic signal inputted into the fifth test pad is disabled, all the first to the sixth sub-pixels are dark.

* * * * *